US009121123B2

(12) United States Patent
Song

(10) Patent No.: US 9,121,123 B2
(45) Date of Patent: Sep. 1, 2015

(54) DETERGENT SUPPLYING APPARATUS OF WASHING MACHINE

(75) Inventor: Hyung Ju Song, Daegu-si (KR)

(73) Assignee: LG ELECTRONICS INC., Seoul (KR)

( * ) Notice: Subject to any disclaimer, the term of this patent is extended or adjusted under 35 U.S.C. 154(b) by 1517 days.

(21) Appl. No.: 11/476,925

(22) Filed: Jun. 29, 2006

(65) Prior Publication Data

US 2007/0079637 A1 Apr. 12, 2007

(30) Foreign Application Priority Data

Oct. 12, 2005 (KR) ..... 10-2005-0096142

(51) Int. Cl.
*D06F 39/02* (2006.01)

(52) U.S. Cl.
CPC ..... *D06F 39/02* (2013.01)

(58) Field of Classification Search
CPC ..... D06F 39/02
See application file for complete search history.

(56) References Cited

U.S. PATENT DOCUMENTS

| | | | | |
|---|---|---|---|---|
| 7,093,467 | B2 * | 8/2006 | Kim et al. | 68/17 R |
| 7,249,473 | B2 * | 7/2007 | Rizzeto et al. | 68/17 R |
| 7,543,465 | B2 * | 6/2009 | Kwon et al. | 68/17 R |
| 7,654,119 | B2 * | 2/2010 | Song | 68/17 R |
| 2005/0229652 | A1 * | 10/2005 | Kim et al. | 68/237 |
| 2005/0274156 | A1 * | 12/2005 | Yang | 68/17 R |

FOREIGN PATENT DOCUMENTS

| | | | | |
|---|---|---|---|---|
| DE | 8013971 | U1 | 8/1980 | |
| DE | 8013971 | U1 * | 8/1980 | D06F 39/02 |
| DE | 60213061 | T2 | 1/2007 | |
| EP | 1449951 | A1 * | 8/2004 | D06F 39/02 |
| KR | 10-2003-0061181 | | 7/2003 | |
| KR | 10-2003-0061193 | | 7/2003 | |
| KR | 10-2005-0036537 | | 4/2005 | |

* cited by examiner

*Primary Examiner* — Michael Barr
*Assistant Examiner* — Jason Riggleman
(74) *Attorney, Agent, or Firm* — Dentons US LLP

(57) ABSTRACT

Provided is a detergent supplying apparatus of a washing machine. The apparatus includes a drawer and drawer caps. The drawer has bleach supplying parts provided with bleach siphon tubes, and softener supplying parts provided with softener siphon tubes. The drawer caps are provided with bleach siphon caps covering the bleach siphon tubes together with softener siphon caps covering the softener siphon tubes.

5 Claims, 12 Drawing Sheets

DETERGENT SUPPLYING APPARATUS OF WASHING MACHINE

This Nonprovisional application claims priority under 35 U.S.C. §119(a) on Patent Application No. 2005-96142 filed in Korea on Oct. 12, 2005, the entire contents of which are hereby incorporated by reference.

BACKGROUND OF THE INVENTION

1. Field of the Invention

The present invention relates to a detergent supplying apparatus of a washing machine provided with a drawer that houses and supplies detergent, and more particularly, to a detergent supplying apparatus of a washing machine, in which one drawer cap is integrally provided with a bleach siphon cap and a softener siphon cap.

2. Description of the Background Art

In general, a washing machine refers to a device for cleaning a laundry through washing, rinsing, dewatering, and drying to decontaminate clothes and bedclothes (Hereinafter, referred to as "laundry").

The washing machine is classified as a home washing machine and a commercial washing machine depending on a purpose of use. The home washing machine is installed at each home, and is used for washing the laundry generated by a member of family. The commercial washing machine is separately installed at a shop or dormitory, and is used for leasing its use to a user desiring to wash the laundry in return for a predetermined use fee.

The commercial washing machine is separately provided with a fee processing unit other than a construction of the general home washing machine, and separately requires a control algorithm of the fee processing unit.

The washing machine is provided with a detergent supplying apparatus for housing detergent, bleach, and softener and then, selectively supplying the detergent, the bleach, and the softener at a necessary time.

The detergent supplying apparatus includes a drawer for housing and supplying the detergent, the bleach, and the softener.

The drawer is disposed at a water supplying flow of the washing machine to mix and supply water passing through the water supplying flow of the washing machine, and is constructed such that it is drawn or disengaged outside to input the detergent, the bleach, and the softener.

FIG. 1 is a perspective view illustrating an example of a drawer used in a conventional washing machine. A detergent supplying part 402 to house and supply detergent is long provided in the front and rear direction at a right side of the drawer 400. A bleach supplying part 404 to house and supply bleach is long provided in the front and rear direction at a center of the drawer 400. A softener supplying part 406 to house softener is long provided in the front and rear direction at a left side of the drawer 400.

In the bleach supplying part 404, a bleach siphon tube 408 is protruded, and the bleach siphon tube 408 is covered with a bleach siphon cap 408'.

In the softener supplying part 406, a softener siphon tube 409 is protruded, and the softener siphon tube 409 is covered with a softener siphon cap 409'.

However, in the conventional detergent supplying apparatus of the washing machine, the drawer 400 is provided with the detergent supplying part 402, the bleach supplying part 404, and the softener supplying part 406 are sequentially disposed in the left and right direction and each of them is long provided back and forth and thus, the drawer 400 is great in its total size and is increased in its manufacturing cost, and it is difficult to even secure a space for installing the drawer 400 in the commercial drum washing machine.

On contrary, there is a drawback in that when the drawer 400 is provided small, the detergent supplying part 402, the bleach supplying part 404, and the softener supplying part 406 are too small provided, thereby causing an insufficient capacity of detergent, and causing each of input ports of the detergent supplying part 402, the bleach supplying part 404, and the softener supplying part 406 to be insufficiently secured in size.

FIG. 2 is a perspective view illustrating another example of a drawer used in the conventional washing machine. A detergent supplying part 412 to house detergent is long provided in the front and rear direction at a right side of the drawer 410. A bleach/softener supplying part 414 to separately house bleach and softener is long provided in the front and rear direction at a left side of the drawer 410.

The bleach/softener supplying part 414 is provided with a box shaped bleach supplying part 416 at an inner and front part, and is provided with a box shaped softener supplying part 418 at an inner and rear part.

In the bleach supplying part 416, a bleach siphon tube 428 is protruded, and the bleach siphon tube 428 is covered with a bleach siphon cap 428'.

In the softener supplying part 418, a softener siphon tube 429 is protruded, and the softener siphon tube 429 is covered with a softener siphon cap 429'.

However, in the conventional detergent supplying apparatus of the washing machine, the bleach supplying part 416 and the softener supplying part 418 are disposed to be spaced apart back and forth within the bleach/softener supplying part 414 of the drawer 410 and thus, when the softener is inputted, the drawer 410 should be drawn until the bleach supplying part 416 and the softener supplying part 418 are all opened. Thus, there is a drawback in that the drawer 410 is greatly increased in its drawing distance and thus, the drawer 410 increases in even its back and forth length.

In the bleach siphon caps 408' and 428' and the softener siphon caps 409' and 429', it is structured that they are easily disengaged from the bleach siphon tubes 408 and 428 and the softener siphon tubes 409 and 429. Thus, there is a drawback in that the bleach siphon caps 408' and 428' and the softener siphon caps 409' and 429' have a great loss possibility and, particularly, the commercial washing machine has a difficulty in its management and maintenance.

The bleach siphon caps 408' and 428' and the softener siphon caps 409' and 429' are comprised of separate parts. Thus, there is a drawback in that the number of parts increases and the parts have a great loss possibility and, particularly, the commercial washing machine has a difficulty in its management and maintenance.

SUMMARY OF THE INVENTION

Accordingly, the present invention is to solve at least the problems and disadvantages of the background art.

The present invention is to provide a detergent supplying apparatus of a washing machine, for minimizing the number of parts.

Also, the present invention is to provide a detergent supplying apparatus of a washing machine, for optimizing a siphon cap structure to thereby minimize a size and a drawing distance of a drawer, and accurately, simply and conveniently input detergent to a detergent supplying part.

Further, the present invention is to provide a detergent supplying apparatus of a washing machine, for preventing arbitrary disengagement of a siphon cap to thereby reduce a danger of loss of the siphon cap, and preventing erroneous assembly of the siphon cap to thereby stably guarantee a detergent supplying performance of the washing machine.

To achieve these and other advantages and in accordance with the purpose of the present invention, as embodied and broadly described, there is provided a detergent supplying apparatus of a washing machine. The apparatus includes a drawer and drawer caps. The drawer has bleach supplying parts provided with bleach siphon tubes, and softener supplying parts provided with softener siphon tubes. The drawer caps are provided with bleach siphon caps covering the bleach siphon tubes together with softener siphon caps covering the softener siphon tubes.

The drawer may be partitioned and provided by a partition part as bleach supplying part and a softener supplying part.

The partition part may be provided at a portion opened at the time of drawing the drawer.

In the partition part, a part may be protruded in front.

In the partition part, a connection part may be provided between a protrusion part and a non-protrusion part, and the bleach siphon tube and the softener siphon tube may be spaced apart approximately left and right near the connection part, with the connection part interposed therebetween.

The drawer cap may include an upper surface part disposed at an upper side of the partition part, a front surface part provided downwardly at a front part of the upper surface part and disposed in front of the partition part, and a rear surface part provided downwardly at a rear part of the upper surface part disposed in rear of the partition part.

The bleach supplying part and the softener supplying part may be spaced apart.

In the bleach supplying part and the softener supplying part, parts of facing wall parts may be protruded in front, respectively.

In the bleach supplying part and the softener supplying part, connection parts may be provided between protrusion parts and non-protrusion parts of the facing wall parts, respectively, and the bleach siphon tube and the softener siphon tube may be provided at sides of the connection parts, respectively.

In the bleach supplying part and the softener supplying part, the protrusion part of any one of both of the facing wall parts may be positioned at a side of the connection part of the other one.

The drawer cap may include an upper surface part positioned at upper sides of facing wall parts of the softener supplying part and the bleach supplying part, a front surface part provided downwardly at a front part of the upper surface part, and a rear surface part provided downwardly at a rear part of the upper surface part.

The drawer cap may be protrusive provided with a locking protrusion inserted into a gap between the bleach supplying part and the softener supplying part and locked at a lower surface part of at least one of the bleach supplying part and the softener supplying part.

The locking protrusion may include a bleach supplying part locking protrusion provided at a lower part with a locking jaw upwardly locked at a lower surface part of the bleach supplying part, and a softener supplying part locking protrusion provided at a lower part with a locking jaw locked at a lower surface part of the softener supplying part.

In the drawer caps, the bleach siphon caps and the softener siphon caps may be downwardly protruded at lower surfaces of the upper surface parts.

Horizontal ribs may be protruded at least one of the front surface parts and the rear surface parts.

In the detergent supplying apparatus of the washing machine according to the present invention, there is an advantage in that one drawer cap is provided with the bleach siphon cap and the softener siphon cap, together, thereby minimizing the number of parts, and when the bleach siphon cap and the softener siphon cap are provided separately, it is easy in maintenance and management.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

Figure 1:
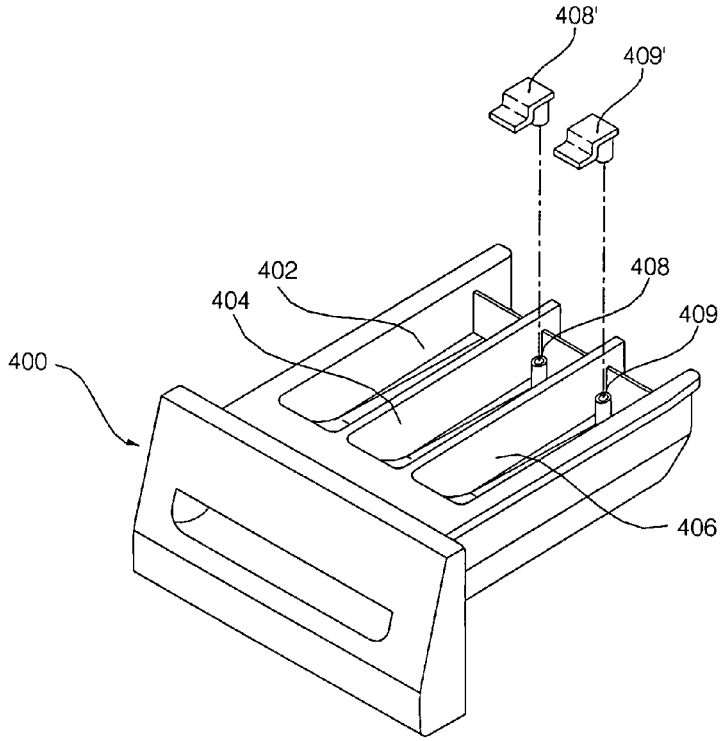
Fig. 1 (related art)
FIG. 1 is a perspective view illustrating an example of a drawer used in a conventional washing machine.
Figure 2:
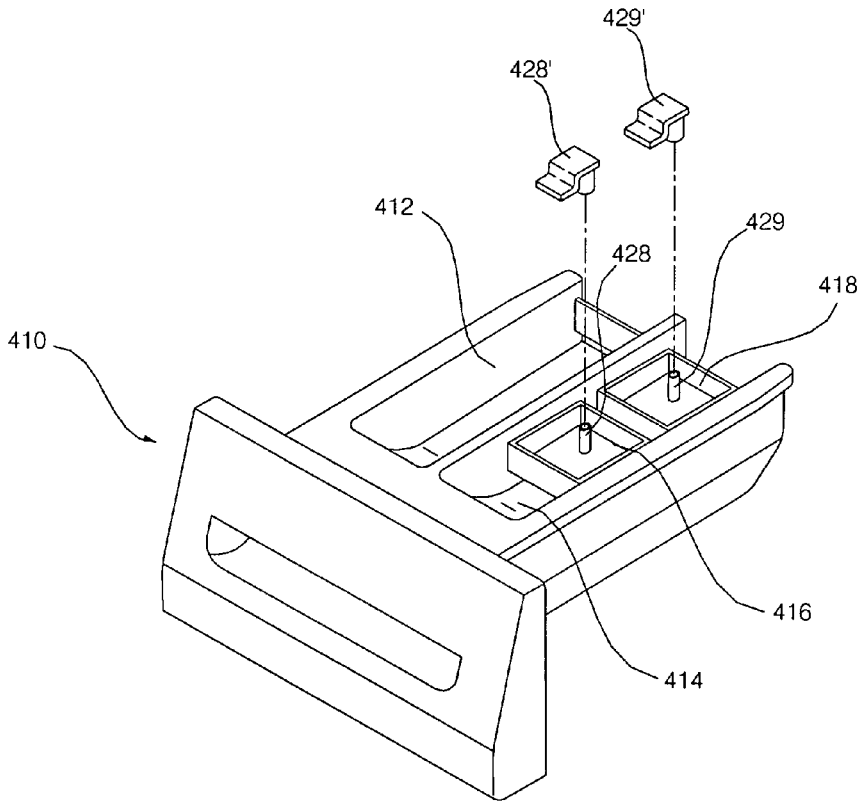
Fig. 2 (related art)
FIG. 2 is a perspective view illustrating another example of a drawer used in a conventional washing machine.
Figure 3:
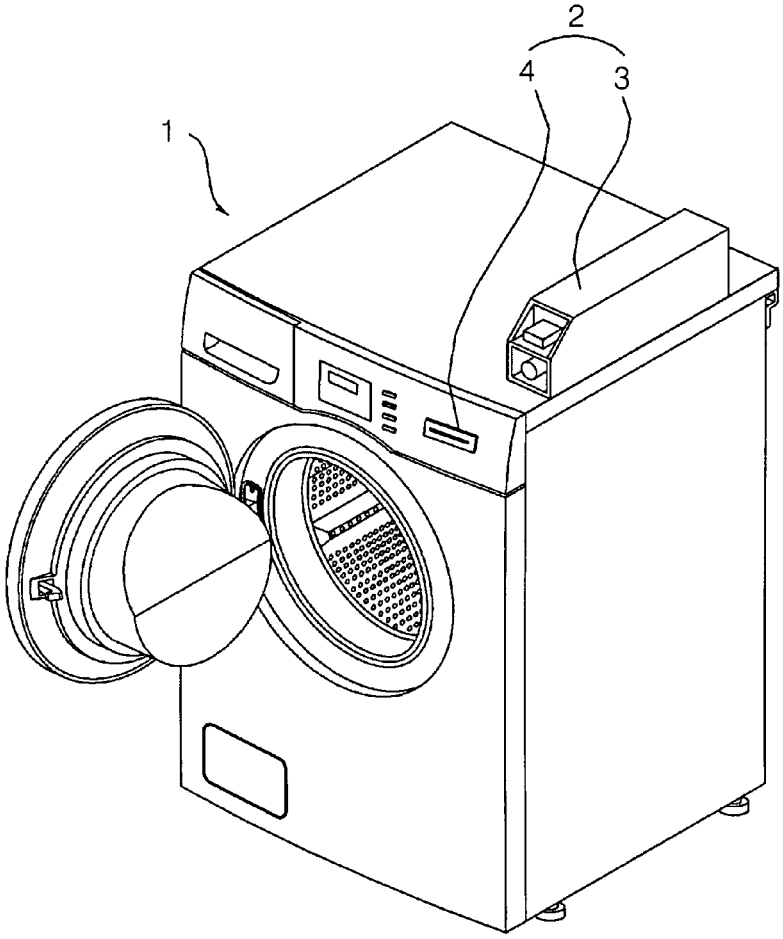
FIG. 3 is a perspective view illustrating a commercial drum washing machine employing a detergent supplying apparatus of a washing machine according to an exemplary embodiment of the present invention.

FIG. 3 is a perspective view illustrating a commercial drum washing machine employing a detergent supplying apparatus of a washing machine according to the present invention.

In the commercial drum washing machine 1 shown in FIG. 3, when a user selects wanted cleaning course and time, a fee processing unit 2 approves a proper fee based on the selected cleaning course or time. By water and detergent and mechanical action, a laundry is washed, rinsed, dewatered, and dried and thus, is decontaminated.

The fee processing unit 2 is comprised of a coil box 3 and a card reader 4.

The coin box 3, a device for approving a fee using a coin, houses, and mechanically processes a plurality of coins. Thus, it is so great in appearance and weight.

On contrary, the card reader 4, a device for approving the fee using a magnetic card or an integrated circuit (IC) card, electronically reads and processes the card. Thus, it is so small in appearance and weight compared with the coin box 3.

The commercial drum washing machine 1 is simultaneously provided with the coin box 3 and the card reader 4 in order to improve user's convenience.

Figure 4:
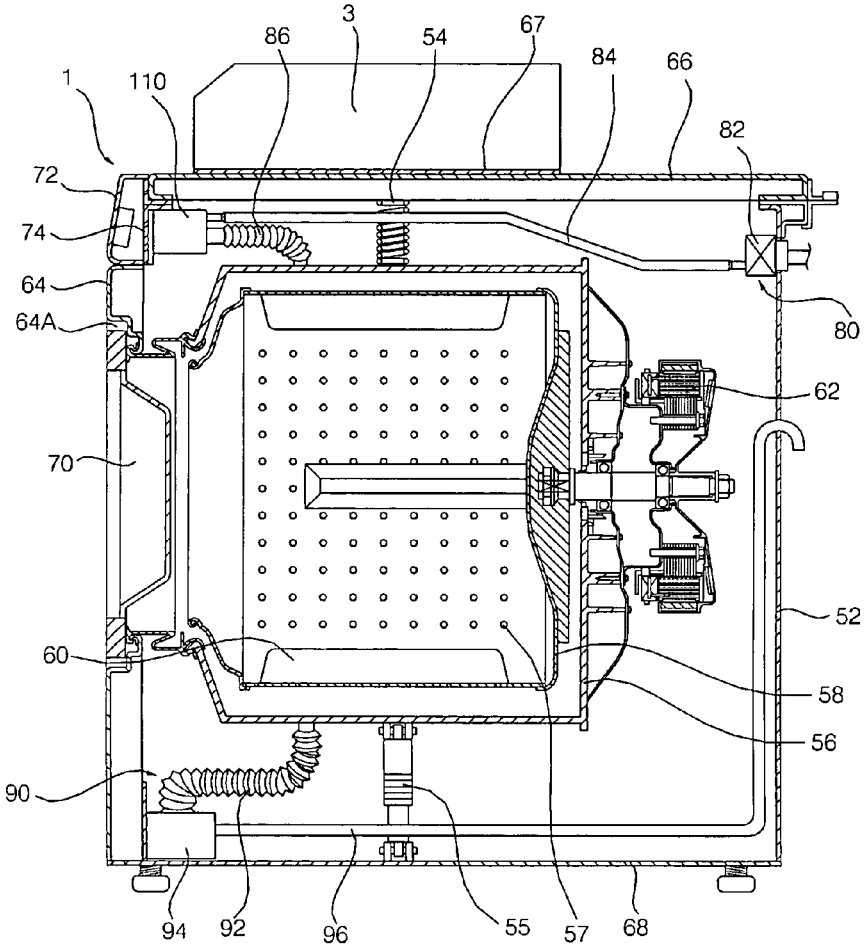
FIG. 4 is a cross-sectional view illustrating an internal construction of the commercial drum washing machine shown in FIG. 3.
Figure 5:
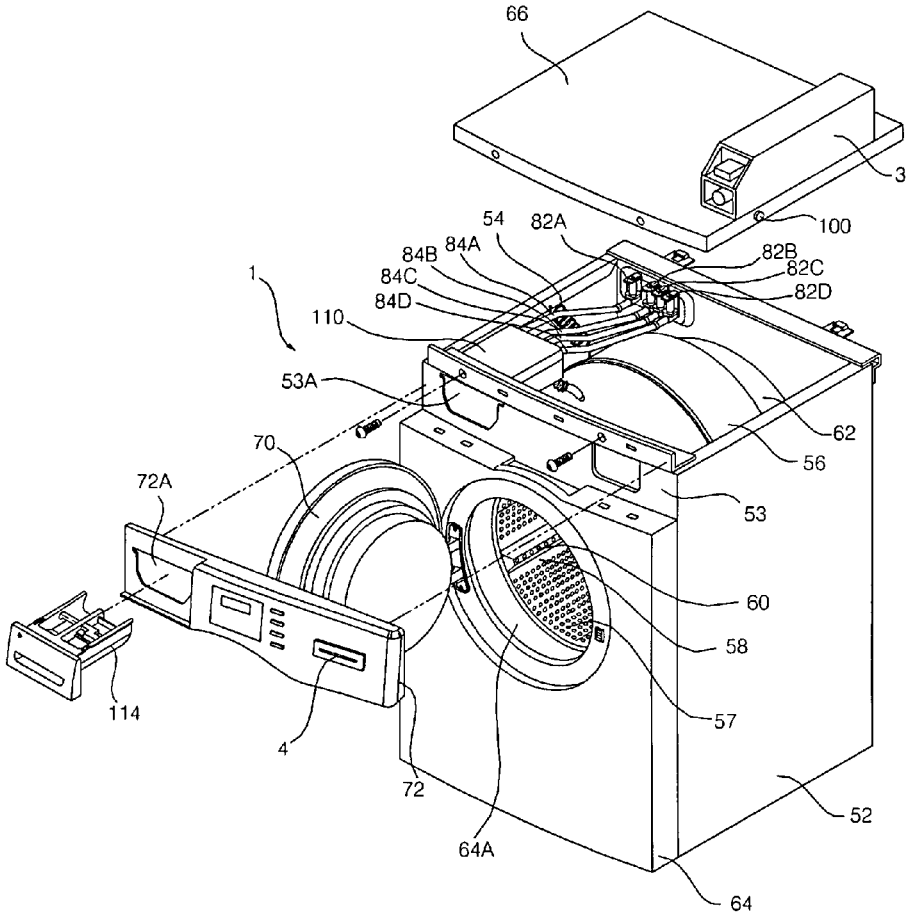
FIG. 5 is an exploded perspective view illustrating a main part of the commercial drum washing machine shown in FIG. 3.

FIG. 4 is a cross-sectional view illustrating an internal construction of the commercial drum washing machine shown in FIG. 3, and FIG. 5 is an exploded perspective view illustrating a main part of the commercial drum washing machine shown in FIG. 3.

As shown in FIGS. 4 or 5, the commercial drum washing machine includes a cabinet 52 forming an appearance; a tub 56 installed inside the cabinet 52; a drum 58 rotatably disposed inside the tub 56 and having a plurality of water holes 57; a lifter 60 installed on an inner circumference surface of the drum 58 and lifting up the laundry by a predetermined height so that the laundry can fall by gravity; and a motor 62 installed in rear of the tub 56 and rotating the drum 58.

The cabinet 52 forms the appearance at left and right parts and a rear part of the commercial drum washing machine 1.

A support frame 53 long provided left and right is mounted at a front and upper side of the cabinet 52, and supports left and right parts of the cabinet 52.

An insertion hole 53A is provided back and forth at the support frame 53 to insert a front end of a dispenser housing 112 described later.

A cabinet cover 64 is installed in front of the cabinet 52 and has a laundry doorway 64A at its center.

A top plate 66 is mounted on an upper surface of the cabinet 52.

The cabinet 52 is put and mounted on the base 68.

A door 70 for opening and closing the laundry doorway 64A is rotatably installed at the cabinet cover 64.

A control panel 72 is installed at an upper side of the cabinet cover 64 to display an operation state of the commercial drum washing machine 1 and control an operation of the commercial drum washing machine 1.

The card reader 4 is installed at the control panel 72.

An opening 72A is provided back and forth at the control panel 72 to allow entrance and exit of the drawer 114 described later.

The coin box 3 is installed at an upper side of the top plate 66, and a buffer pad 67 is provided on an upper surface of the top plate 66. The coin box 3 is put and installed on the buffer pad 67.

The coin box 3 and the card reader 4 connect with an electronic equipment of the control panel 72 such that they can transmit a signal, to control an operation by the control panel 72 and display a fee processing state for the exterior.

A wire of the coin box 3 passes through the buffer pad 67 and the top plate 66 and then, is wired toward the control panel 72 along a lower surface of the top plate 66.

The tub 56 is connected to the cabinet 52 by a spring 54, and is installed at the base 68 such that it can be buffered using a damper 55.

A water supplying unit 80 is installed at an upper side of the tub 56.

The water supplying unit 80 includes a water supplying valve 82 for controlling water supplied from an external water source; a water supplying hose 84 for guiding the water passing through the water supplying valve 82; the detergent supplying apparatus 110 for mixing the water guided by the water supplying hose 84, with any one of detergent, softener, and bleach, and discharging the mixture; and a water supplying bellows 86 for guiding and supplying the water, which passes through the detergent supplying apparatus 110 and is mixed with the detergent and the like, into the tub 56. Parts of the water supplying valve 82, the water supplying hose 84, and the detergent supplying apparatus 110, and the water supplying bellows 86 form a water supplying flow of the washing machine.

The water supplying valve 82 is installed to pass through a top of a rear surface of the cabinet 52. The water supplying valve 82 includes a hot water valve 82A for introducing hot water from the exterior, and cool water valves 82B, 82C, and 82D for introducing cool water from the exterior.

The water supplying hose 84 is connected between the water supplying valve 82 and the detergent supplying apparatus 110 to guide the water to the detergent supplying apparatus 110. The water supplying hose 84 includes a hot water hose 84A connecting between the hot water valve 82A and the detergent supplying apparatus 110; and first, second, and third cool water hoses 84B, 84C, and 84D connecting between the cool water valves 82B, 82C, and 82D and the detergent supplying apparatus 110.

As shown in FIG. 4, a water draining unit 90 is installed at a lower side of the tub 56 to discharge a washing water used for washing and rinsing, and water dewatered from a bag (Hereinafter, referred to as "washing water"), to the exterior of the commercial drum washing machine.

The water draining unit 90 includes a water draining bellows 92 connecting to a water draining port of the tub 56; a water draining pump 94 connecting with the water draining bellows 92; and a water draining hose 96 for guiding the washing water pumped by the water draining pump, to the exterior of the commercial drum washing machine.

Figure 6:
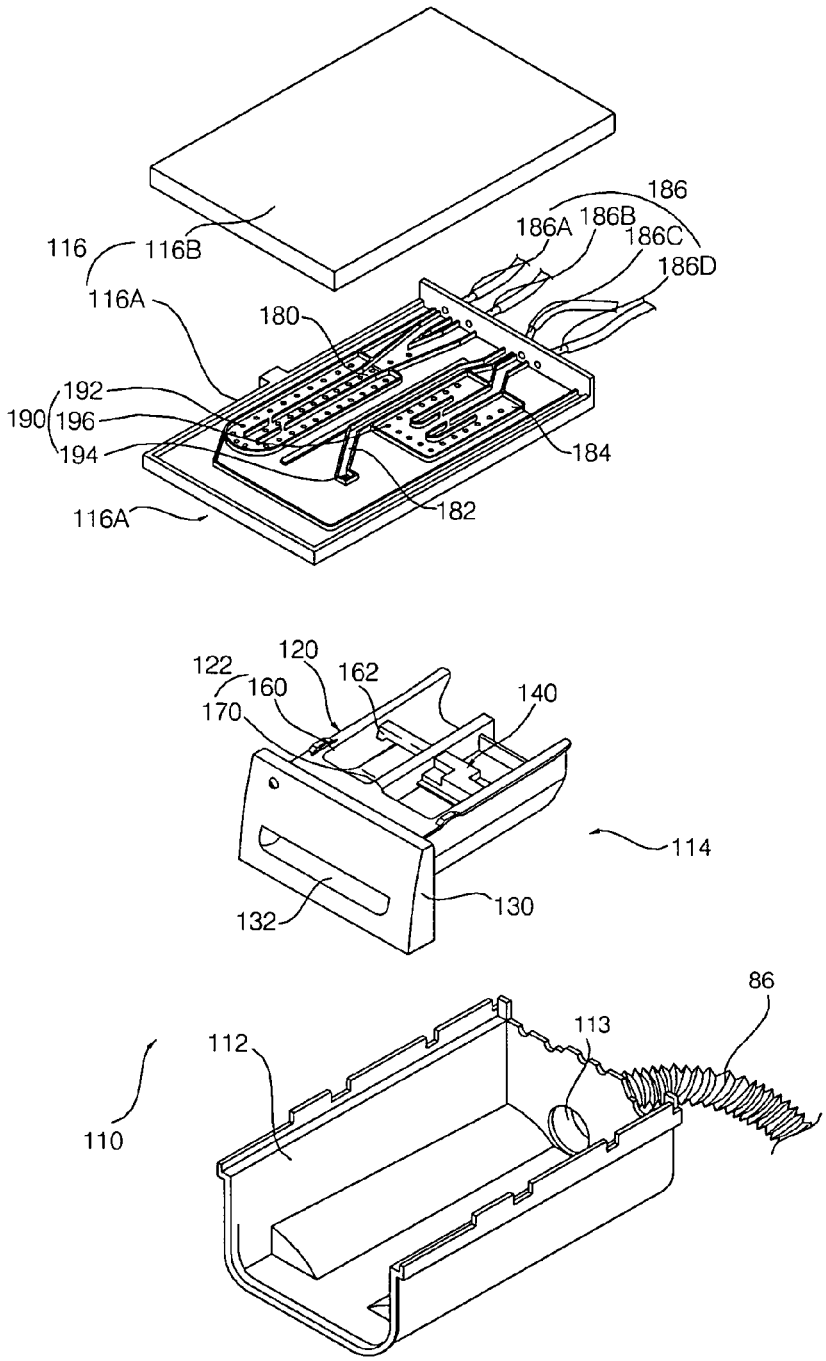
FIG. 6 is an exploded perspective view illustrating a detergent supplying apparatus shown in FIG. 5.
Figure 7:
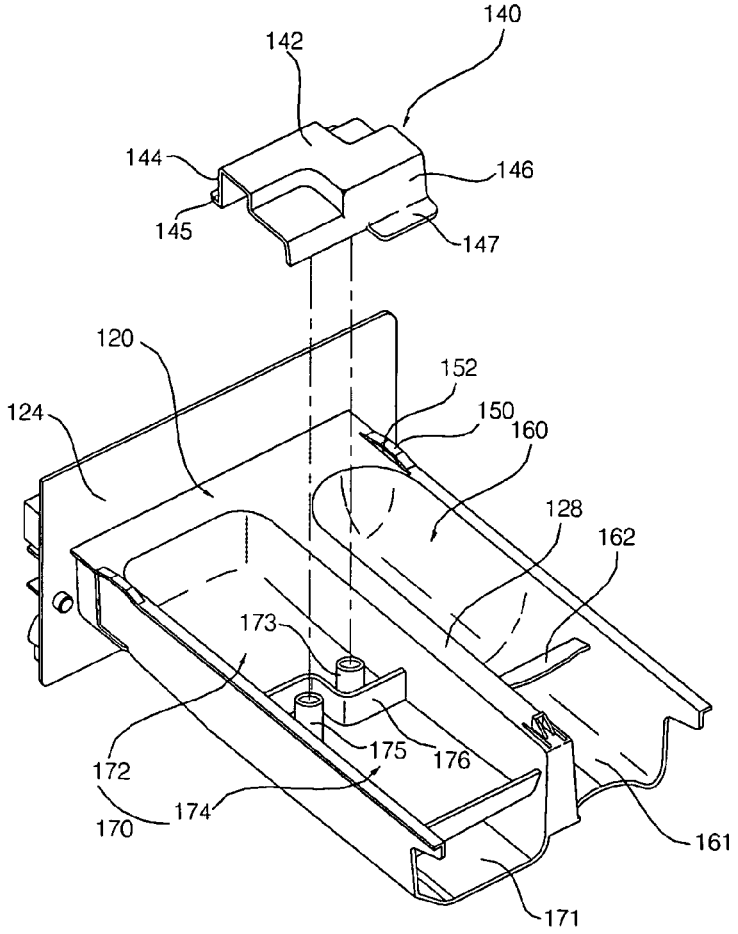
FIG. 7 is an exploded perspective view illustrating a drawer shown in FIG. 6 and a drawer cap separated therefrom.
Figure 8:
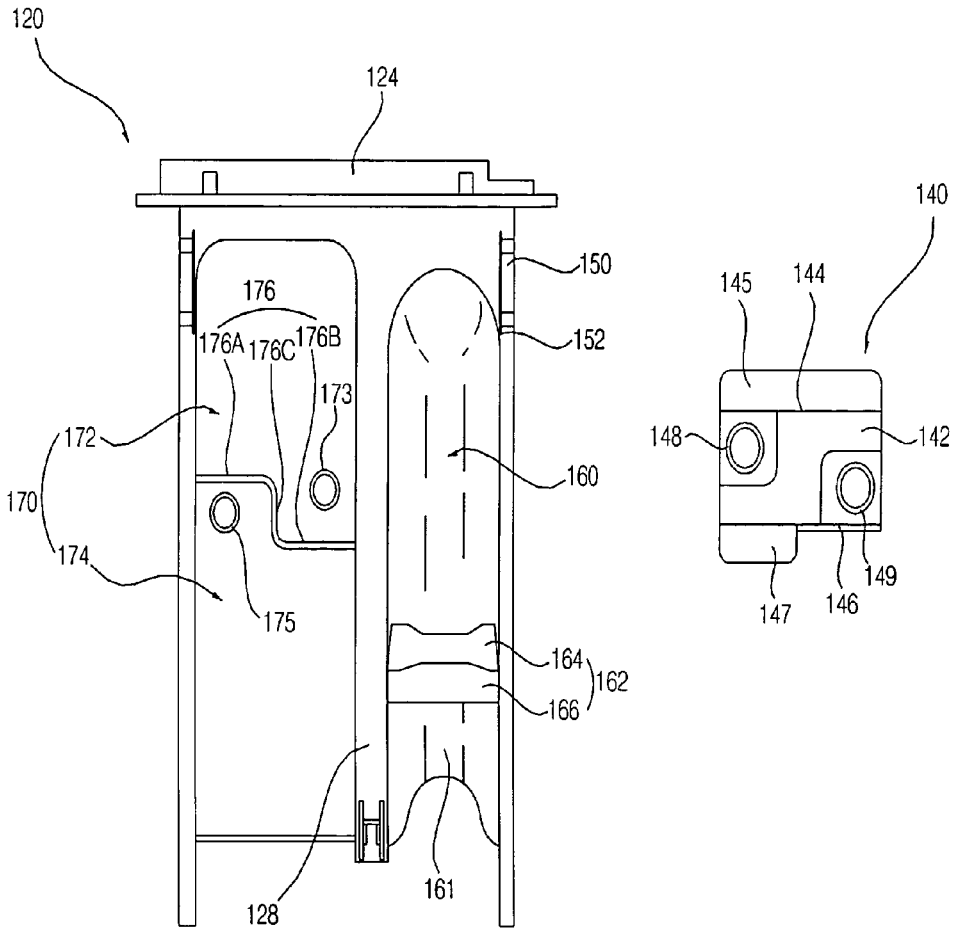
FIG. 8 is an exploded view illustrating a drawer shown in FIG. 6 and a drawer cap separated therefrom.

FIG. 6 is an exploded perspective view illustrating the detergent supplying apparatus shown in FIG. 5, FIG. 7 is an exploded perspective view illustrating the drawer shown in FIG. 6 and the drawer cap separated therefrom, and FIG. 8 is an exploded view illustrating the drawer shown in FIG. 6 and the drawer cap separated therefrom.

As shown in FIG. 6, the detergent supplying apparatus 110 includes a dispenser housing 112 connecting and communicating with the water supplying bellows 86 and opened in its front and top; the drawer 114 detachably installed in the front and rear direction within the dispenser housing 112, and housing the detergent; a dispenser cover 116 provided to cover an opened top of the dispenser housing 112, connecting with the water supplying hose 84, and supplying water into the drawer 114.

The dispenser housing 112 is installed in rear of the support frame 53 such that it communicates in front with the opening 72A of the control panel 72 shown in FIG. 5.

A water draining port 113 is provided at a lower part of the dispenser housing 112 to connect with the water supplying bellows 86 such that a mixture liquid of detergent and water dropping from the drawer 114 can be supplied inside the tub 56.

The drawer 114 is inserted into the dispenser housing 112, which is the water supplying flow of the washing machine, through the opening 72A of the control panel 72 and opening 53A of the support frame 53. The drawer 114 is disposed at the water supplying flow of the washing machine or is drawn to the exterior.

The drawer 114 includes a drawer body 120 for housing and supplying the detergent, softener, and bleach; and a front panel 130 combined to a front surface of the drawer body 120 and having a handle 132 in its front.

A drawer cap 140 is mounted on an upper surface of the detergent supplying part 122.

The drawer body 120 is provided to have a box shape opened in top and rear, and is provided with a front part 124 for mounting the front panel 130, in its front.

The drawer body 120 is integrally provided with a locking part 150 elastically locked in front of the dispenser cover 116 such that, whenever the drawer 114 is put in or out of the opening 72A of the control panel 72, the user feels a sense of attachment and detachment.

The locking part 150 is provided and inclined at a predetermined angle in front and rear parts, and is long provided with a slit hole 152 back and forth such that at least any one of left and right sides can be elastically deformed.

When the drawer 114 is inserted inside the dispenser cover 116 and the dispenser housing 112, the locking part 150 is locked by a front part of the dispenser cover 116, is elastically deformed downwardly, and is closely attached to a lower surface of the dispenser cover 116.

The drawer 114, specifically, the drawer body 120 includes a detergent supplying part 160 for housing and supplying the detergent; and a bleach/softener supplying part 170 for housing and supplying at least one of the softener and the bleach. A connection part 128 is provided between an upper end of the detergent supplying part 160 and an upper end of the bleach/softener supplying part 170.

The detergent supplying part 160 is provided to have the approximately same area as a whole of the bleach/softener supplying part 170.

The detergent supplying part 160 is provided to have a box shape opened in its top and rear.

The detergent supplying part 160 is provided with a detergent amount setting wall 162 at a position spaced by a predetermined distance in rear of the front panel 130, to prevent a powder detergent of lump state from dropping to the dispenser housing 112 and also, to set a capacity of the detergent that can be housed in the detergent supplying part 160.

The detergent amount setting wall 162 are plate-shaped members horizontally provided left and right. The detergent amount setting wall 162 connect, in both ends, to left and right wall parts of the detergent supplying part 160, and are spaced apart by a predetermined distance from a bottom surface 161 of the detergent supplying part 160 to form a passage through which the detergent is discharged to the dispenser housing 112.

The detergent amount setting wall 162 is provided such that it is positioned correspondingly to the opening 72A of the control panel 72 at the time of maximally drawing the drawer 114 to the front of the opening 72A of the control panel 72, to set a detergent input space to the detergent supplying part 160.

The detergent amount setting wall 162 is comprised of an inclination surface part 164 inclined downwardly in front such that its bottom end is disposed in front of the opening 72A of the control panel 72; and a horizontal surface part 166 provided horizontally by a predetermined length in rear such that its top end is disposed in rear of the opening 72A.

The bleach/softener supplying part 170 is provided to wholly have a box shape opened in its top and rear.

The bleach/softener supplying part 170 is provided with a bleach supplying part 172 for housing and supplying the bleach and a softener supplying part 174 for housing and supplying the softener.

The bleach supplying part 172 and the softener supplying part 174 are partitioned approximately back and forth by a partition part 176.

The bleach supplying part 172 is provided at an inner and front part of the bleach/softener supplying part 170.

The bleach supplying part 172 is upwardly protruded and communicated at its lower side with the bleach siphon tube 173.

The softener supplying part 174 is provided at an inner and rear part of the bleach/softener supplying part 170.

The softener supplying part 174 is upwardly protruded and communicated at its lower side with the softener siphon tube 175.

The partition part 176 is a partition rib long provided in the left and right direction at an inner and upper part of the bleach/softener supplying part 170 such that it partitions the bleach/softener supplying part 170 as the bleach supplying part 172 and the softener supplying part 174.

The partition rib 176 is upwardly protruded from a bottom surface 171 of the bleach/softener supplying part 170, or is upwardly protruded within a separate box part spaced apart to an upper side from the bottom surface 171 of the bleach/softener supplying part 170.

Hereinafter, a description will be made on the basis of limitation that the bleach/softener supplying part 170 is provided with the box part spaced apart from the bottom surface 171 of the bleach/softener supplying part 170, and the partition rib 176 is upwardly protruded from a bottom surface of the box part and thus, an internal space of the box part is partitioned back and forth by the softener supplying part 174 of the bleach supplying part 172.

A description will be made on the basis of limitation that, on the basis of the partition rib 176, the bleach supplying part 172 is provided in front, and the softener supplying part 174 is provided in rear.

The partition rib 176 is provided such that it is more protruded at any one of left and right sides thereof in front and is bent in a ⌐ -shape.

Hereinafter, in the partition rib 176, a portion more protruded in front is defined as "protrusion part 176A", and a portion not protruded in front is defined as "non-protrusion part 176B", and a portion between the protrusion part 176A and the non-protrusion part 176B is defined as "connection part 176C".

In the partition rib 176, the protrusion part 176A is provided left and right at one of the left and right wall parts of the bleach/softener supplying part 170, and the connection part 176C is provided back and forth in rear at an end of the protrusion part 176A, and the non-protrusion part 176B is provided left and right to the other one of the left and right wall parts of the bleach/softener supplying part 170 at a rear end of the connection part 176C.

In the bleach/softener supplying part 170, the bleach siphon tube 173 is provided in proximal to a front part of the non-protrusion part 176B of the bleach supplying part 172, and the softener siphon tube 175 is provided in proximal to a rear part of the protrusion part 176A of the softener supplying part 174.

In other words, in the bleach/softener supplying part 170, the bleach siphon tube 173 and the softener siphon tube 175 are spaced apart approximately left and right with the partition rib, particularly, the connection part 176C interposed therebetween and thus, are in proximal to each other to the maximum.

The drawer cap 140 is detachable from the drawer 114.

The drawer cap 140 is provided with the bleach siphon cap 148 covering the bleach siphon tube 173 and the softener siphon cap 149 covering the softener siphon tube 175, together.

In the drawer cap 140, the bleach siphon tube 173 and the softener siphon tube 175 are provided to be in proximal to each other to the maximum with the partition rib 176, specifically, the connection part 176C interposed therebetween and thus, its back and forth length can be provided shortly to the maximum.

The drawer cap 140 includes an upper surface part 142 horizontally disposed at an upper side of the partition rib 176 and having a bottom surface from which the bleach siphon cap 148 and the softener siphon cap 149 are integrally protruded; a front surface part 144 extended downwardly at a front part of the upper surface part 142 and positioned in front of the partition rib 176; and a rear surface part 146 extended downwardly at a rear part of the upper surface part 142 and positioned in rear of the partition rib 176.

In the upper surface part 142 that is a part covering the bleach siphon tube 173, the softener siphon tube 175, and the partition rib 176, the bleach siphon cap 148 is protruded at a position facing the bleach siphon tube 173, and the softener siphon cap 149 is protruded at a position facing the softener siphon cap 175.

The front surface part 144 is downwardly protruded by a maximal height up to which the bleach is housed inside the bleach supplying part 172 at the front part of the upper surface part 142. The front surface part 144 is provided at its rear end with a front horizontal rib 145 horizontally protruded in front, by a predetermined length.

The rear surface part 146 is downwardly protruded by a maximal height up to which the softener is housed inside the softener supplying part 174 at the rear part of the upper surface part 142. The rear surface part 146 is provided at its rear end with a rear horizontal rib 147 horizontally protruded in rear, by a predetermined length.

The front horizontal rib 145 and the rear horizontal rib 147 indicate a storage amount of the bleach housed in the bleach supplying part 172 and a storage amount of the softener housed in the softener supplying part 174 and also, are used as a handle when the drawer cap 140 is attached and detached.

The dispenser cover 116 includes a lower panel 116A mounted on an opened upper surface of the dispenser housing 112; and an upper panel 116B up-mounted on an upper part of the lower panel 116A to form a detergent water supplying flow 180, a bleach water supplying flow 182, and a softener water supplying flow 184 together with the lower panel 116A.

In the lower panel 116A, a hose connection part 186 connecting with the water supplying hose 84 of the water supplying unit 80 is protruded and communicated at its rear part, and a plurality of water supplying holes 190 for supplying the water are provided at portions facing the detergent supplying part 160 and the bleach/softener supplying part 170 of the drawer 114.

The hose connection part 186 includes a first hose connection part 186A connecting with the hot water hose 84A such that it supplies hot water to the detergent supplying water flow 180; and second, third, and fourth connection parts 186B, 186C, and 186D connecting with the first, second, and third cool water hoses 84B, 84C, and 84D such that they supply cool water to the bleach water supplying flow 182, the softener water supplying flow 184, and the detergent water supplying flow 180.

The lower panel 116A is provided with the detergent water supplying flow 180 such that the cool water or the hot water can flow from the first and second hose connection parts 186A and 186B to a portion facing the detergent supplying part 160, and is provided with the bleach water supplying flow 182 such that the cool water can flow from the third hose connection part 186C to a portion facing the bleach supplying part 172, and is provided with the softener water supplying flow 184 such that the cool water can flow from the fourth hose connection part 186D to the softener supplying part 174.

The water supplying hole 190 includes a plurality of detergent water supplying holes 192 provided at an upper side of the detergent supplying part 160 such that the water within the detergent water supplying flow 180 can be supplied to the detergent supplying part 160; a single bleach water supplying hole 194 provided at an upper side of the bleach supplying part 172 such that the water within the bleach water supplying flow 182 can be supplied to the bleach supplying part 172; and a plurality of softener water supplying holes 196 provided at an upper side of the softener supplying part 174 such that the water within the softener water supplying flow 184 can be supplied to the softener supplying part 174.

The detergent water supplying hole 192 is provided in plural at the portion facing the detergent supplying part 160. The bleach water supplying hole 194 is provided at the portion facing the bleach supplying part 172. The softener water supplying hole 196 is provided at the portion facing the softener supplying part 174.

The detergent water supplying hole 192 is provided at left and right surfaces of the detergent supplying part 160 such that the water can be inclined and sprayed to smoothly wash down the powder detergent housed in the detergent supplying part 160.

In other words, the powder detergent has a great possibility of remaining on an inner surface of the detergent supplying part 160 without not being completely washed down and thus, the detergent supplying hole 192 sprays the water to the inner surface of the detergent supplying part 160.

The bleach water supplying hole 194 and the bleach water supplying hole 196 are provided such that the water can be vertically sprayed into the bleach supplying part 172 and the softener supplying part 174, thereby well dissolving the bleach and the softener housed in the bleach supplying part 172 and the softener supplying part 174.

In other words, if the bleach and the softener are not well dissolved and are increased in viscosity, a siphon phenomenon of the bleach siphon tube 173 and the bleach siphon cap 148 does not smoothly work, thereby deteriorating a performance of discharging the bleach, and a siphon phenomenon of the softener siphon tube 175 and the softener siphon cap 149 does not smoothly work, thereby deteriorating a performance of discharging the softener. Thus, the water is vertically sprayed to the bleach and the softener using the bleach water supplying hole 194 and the softener water supplying hole 196, thereby crushing the bleach and the softener by water pressure.

Specifically, like the detergent water supplying flow 180, the softener water supplying flow 184 is provided at the portion facing the softener supplying part 174 in the lower panel 116A, and the plurality of softener water supplying holes 196 are provided along the softener water supplying flow 184.

If the water is sprayed to a whole of the softener supplying part 174 using the softener water supplying flow 184 and the plurality of softener water supplying holes 196, a performance of crushing the softener housed in the softener supplying part 174 is greatly improved.

An operation of the above constructed detergent supplying apparatus of the washing machine according to the present invention will be described below.

First, before the laundry is washed using the commercial drum washing machine 50, the detergent, the bleach, and the softener are inputted to the detergent supplying apparatus 110.

The drawer 114 of the detergent supplying apparatus 110 is drawn in front from the opening 72A of the control panel 72, and is opened at its front part such that the detergent, the bleach, and the softener can be inputted to the detergent supplying part 160, the bleach supplying part 172, and the softener supplying part 174, respectively.

In the detergent supplying part 160, the detergent amount setting wall 162 is disposed at a lower side of the opening 72A of the control panel 72 and thus, the detergent is not inputted in rear of the detergent amount setting wall 162, thereby preventing a waste of the detergent.

In the bleach/softener supplying part 170, the drawer cap 140 is provided at an upper side of the partition rib 176 for partitioning it as the bleach supplying part 172 and the softener supplying part 174. The bleach is inputted to the bleach supplying part 172 through the front part of the drawer cap 140, and the softener is inputted to the softener supplying part 174 through the rear part of the drawer cap 140.

The front horizontal rib 145 provided to the front part 144 of the drawer cap 140 controls a maximal input amount of the bleach inputted to the bleach supplying part 172. The rear horizontal rib 147 provided to the rear part 146 of the drawer cap 140 controls a maximal input amount of the softener to the softener supplying part 174. The front horizontal rib 145 and the rear horizontal rib 147 can prevent an excessive input of the bleach and the softener.

In the bleach/softener supplying part 170, the partition rib 176 is protruded at any one of the left and right sides, and the bleach siphon tube 173 and the softener siphon tube 175 are disposed in proximity, and the drawer cap 140 is compactly constructed such that the front and rear length is minimized. Thus, the bleach input space and the softener input space provided between the drawer cap 140 and the control panel 74 are great, and the user can easily input the bleach and the softener.

After the detergent, the bleach, and the softener are inputted to the detergent supplying part 122 of the drawer 114 as above, if the drawer 114 is inserted into the opening 72A of the control panel 72, the drawer 114 is disposed inside the dispenser housing 112.

After that, as the commercial drum washing machine 50 is activated, the external water is supplied into the detergent supplying apparatus 110 through the water supplying hose 84 of the water supplying unit 80.

In other words, the water is introduced into the dispenser cover 116 of the detergent supplying apparatus 110 through the hose connection part 186 connecting with the water supplying hose 84 of the water supplying unit 80, and the introduced water flows along the detergent water supplying flow 180, the bleach water supplying flow 182, or the softener water supplying flow 184, and is discharged downwardly through the detergent water supplying hole 192, the bleach water supplying hole 194, or the softener water supplying hole 196.

The water discharged through the detergent water supplying hole 192 is supplied into the detergent supplying part 160. The water is inclined and sprayed to a side surface of the detergent supplying part 160, thereby more effectively washing down the powder detergent inputted to the detergent supplying part 160.

The water and the detergent within the detergent supplying part 160 pass between the bottom surface 161 and the detergent amount supplying wall 162 of the detergent supplying part 160 and then, is discharged into the dispenser housing 112.

The water discharged through the bleach water supplying hole 194 or the softener water supplying hole 196 is supplied into the bleach supplying part 172 or the softener supplying part 174, respectively. The water is vertically sprayed to the bleach and the softener to effectively reduce their viscosities.

When the water is supplied into the bleach supplying part 172 and reaches a predetermined water level or more, the bleach and the water housed in the bleach supplying part 172 are discharged to the dispenser housing 112, passing through between the softener siphon tube 175 and the softener siphon cap 149, by the siphon phenomenon.

In particular, the water is sprayed and showered to the softener supplying part 174 through the plurality of softener water supplying holes 196, and the softener is effectively crushed by the water pressure and is greatly reduced in viscosity, and the softener is well diluted in the water and is smoothly discharged through the softener siphon cap 175 and the softener siphon cap 149.

Figure 9:
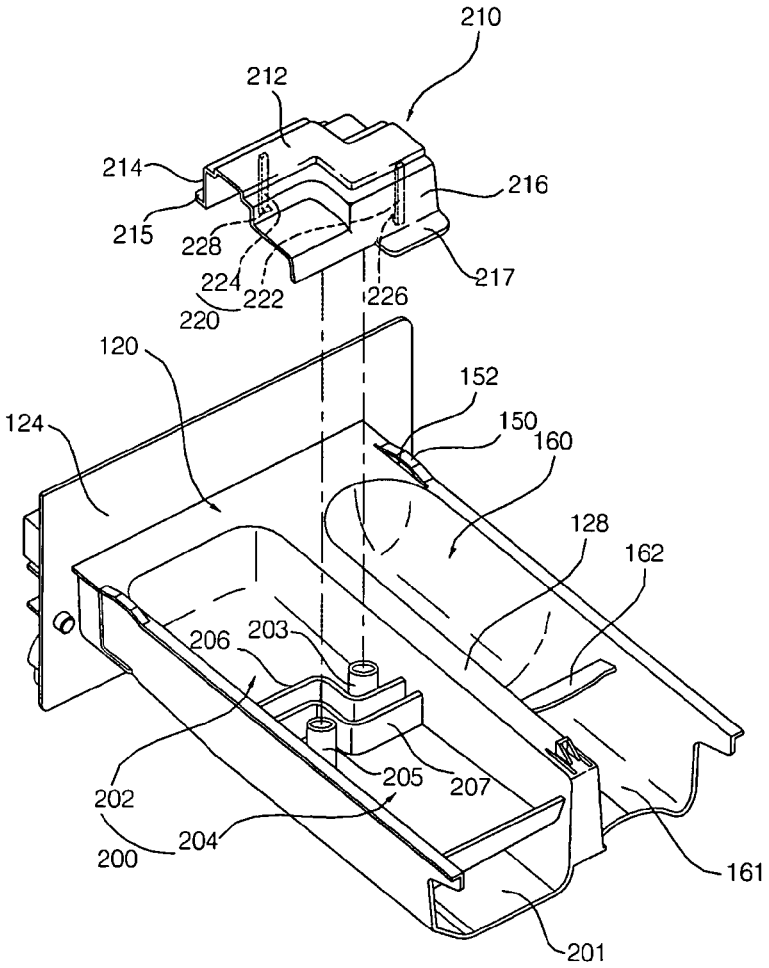
FIG. 9 is an exploded perspective view illustrating a drawer of a detergent supplying apparatus of a washing machine according to another exemplary embodiment of the present invention.
Figure 10:
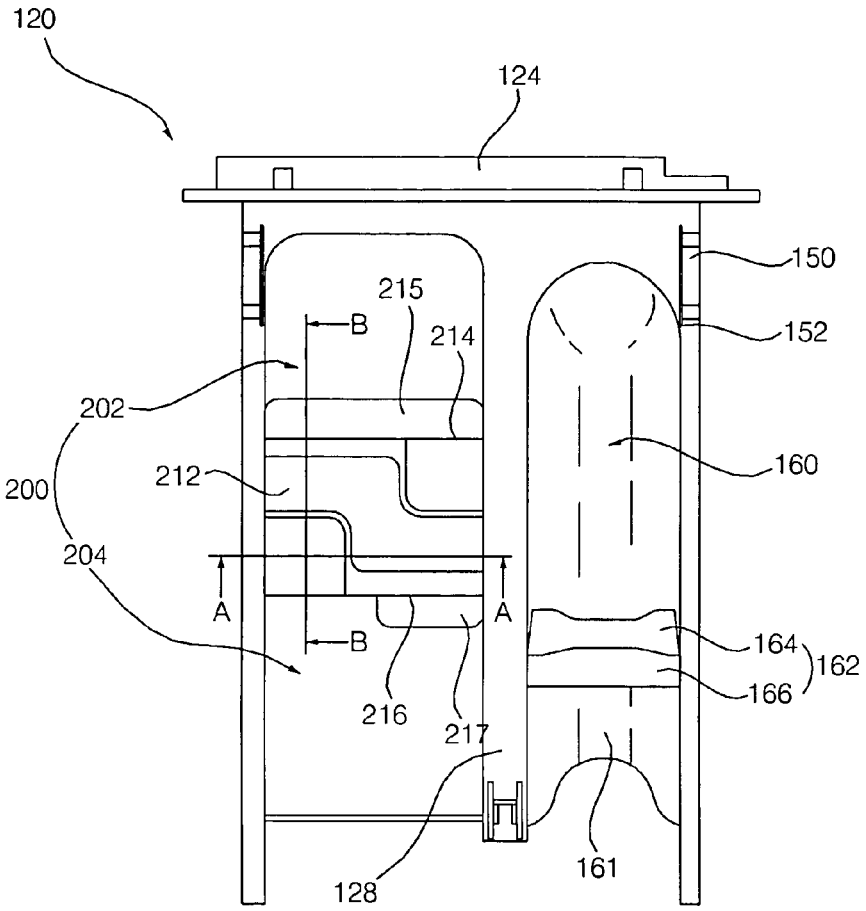
FIG. 10 is a plan view illustrating a drawer cap shown in FIG. 9 and a drawer combined thereto.
Figure 11:
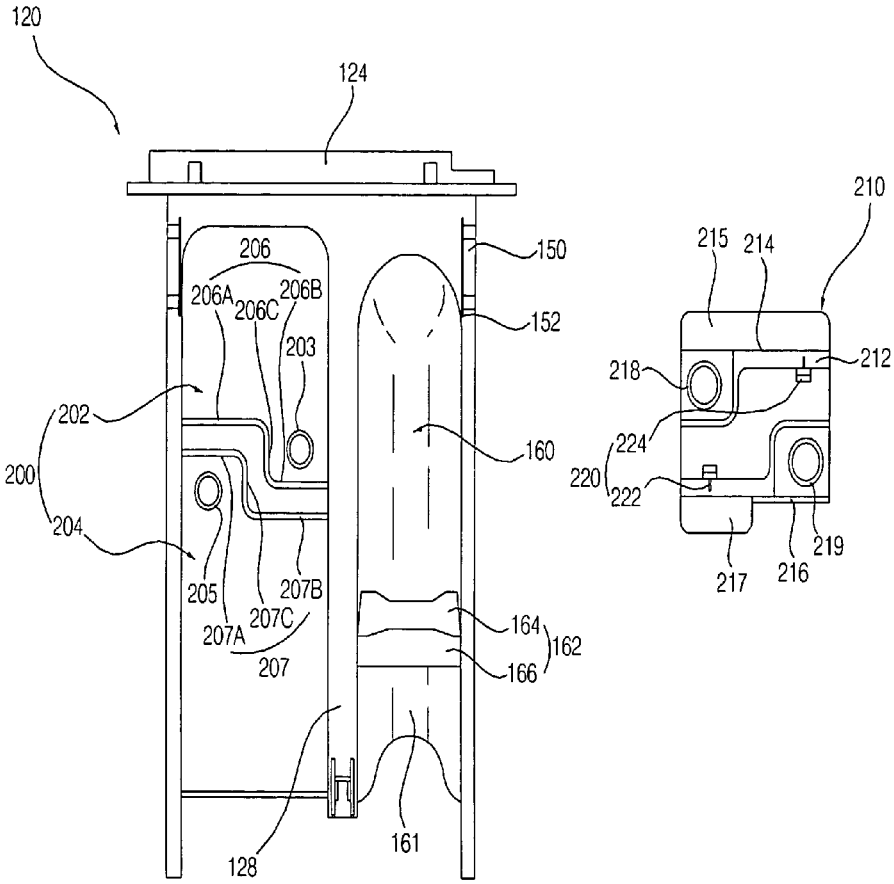
FIG. 11 illustrates a drawer cap shown in FIG. 10 and a drawer separated therefrom.
Figure 12:
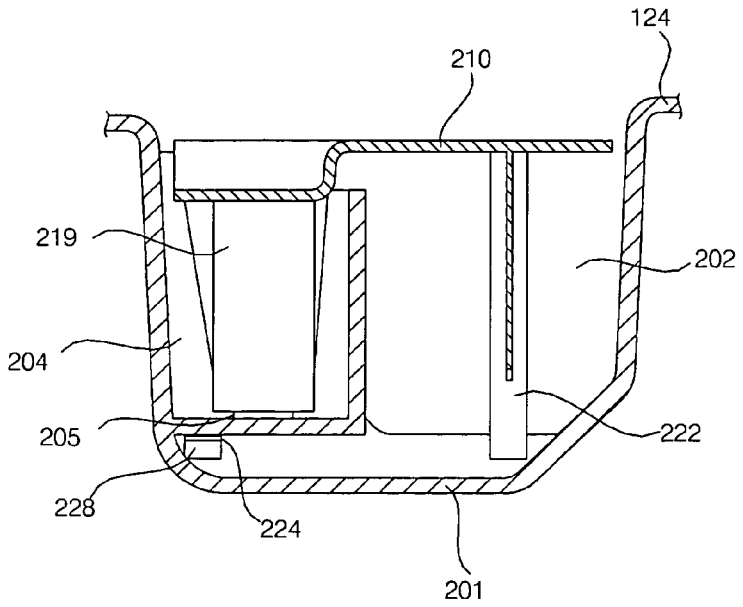
FIG. 12 illustrates a cross section taken along a line A-A of FIG. 10.
Figure 13:
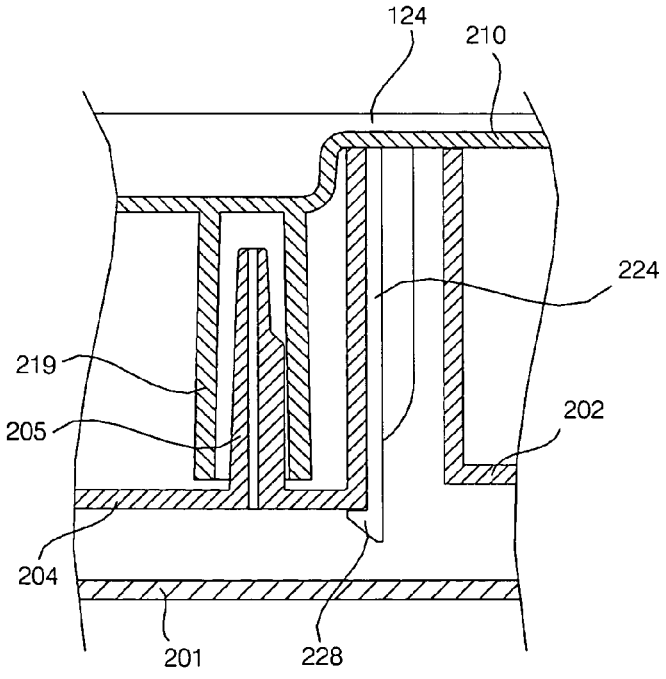
FIG. 13 illustrates a cross section taken along a line B-B of FIG. 10.

FIG. 9 is an exploded perspective view illustrating a drawer of a detergent supplying apparatus of a washing machine according to another exemplary embodiment of the present invention, FIG. 10 is a plan view illustrating a drawer cap shown in FIG. 9 and the drawer combined thereto, FIG. 11 illustrates the drawer cap shown in FIG. 10 and the drawer separated therefrom, FIG. 12 illustrates a cross section taken along a line A-A of FIG. 10, and FIG. 13 illustrates a cross section taken along a line B-B of FIG. 10.

For reference, the same reference numbers indicate the same or like constituent elements of the first embodiment of the present invention and thus, their detailed descriptions will be omitted.

In the drawer 114 shown in FIGS. 9 to 13, a bleach supplying part 202 and a softener supplying part 204 are spaced apart, respectively, at positions spaced apart by a predetermined height, at an upper side from a bottom surface 201 within a bleach/softener supplying part 200.

The bleach supplying part 202 and the softener supplying part 204 are provided to have box shapes opened in top, respectively, and are spaced apart back and forth at an inner and front part and an inner and rear part of the bleach/softener supplying part 200.

In the bleach/softener supplying part 200, wall parts 206 and 207 facing the bleach supplying part 202 and the softener supplying part 204 are spaced apart back and forth and also, are provided to have '⌐' shapes, respectively.

In other words, in the rear wall part 206 of the bleach supplying part 202 and the front wall part 207 of the softener supplying part 204, any one of the left and right sides is protruded in front such that they are bent to have the '⌐'-shapes.

In the rear wall part 206 of the bleach supplying part 202, a portion more protruded in front is defined as "protrusion part 206A", and a portion not protruded in front is defined as "non-protrusion part 206B", and a portion between the protrusion part 206A and the non-protrusion part 206B is defined as "connection part 206C".

In the rear wall part 206 of the bleach supplying part 202, the protrusion part 206A is provided left and right at one of the left and right wall parts of the bleach/softener supplying part 200, and the connection part 206C is provided in rear at an end of the protrusion part 206A, and the non-protrusion part 206B is provided left and right to the other one of the left and right wall parts of the bleach/softener supplying part 170 at a rear end of the connection part 206C.

In the bleach supplying part 202, the bleach siphon tube 203 is provided in proximal to a front part of the non-protrusion part 206B to the maximum and is approximately positioned at a side of the connection part 206C.

In the front wall part 207 of the bleach supplying part 202, the protrusion part 207A is provided left and right at one of the left and right wall parts of the bleach/softener supplying part 200, and the connection part 207C is provided in rear at an end of the protrusion part 207A, and the non-protrusion part 207B is provided left and right the to the other one of the left and right wall parts of the bleach/softener supplying part 200 at a rear end of the connection part 207C.

In the softener supplying part 204, the softener siphon tube 205 is provided in proximal to a rear part of the protrusion part 207A to the maximum and is approximately positioned at a side of the connection part 207C.

In other words, in the bleach/softener supplying part 200, the bleach siphon tube 203 and the softener siphon tube 205 are provided in proximity to the maximum, with the connection part 206C of the rear wall part 206 of the bleach supplying part 202 and the connection part 207C of the front wall part 207 of the softener supplying part 204 interposed therebetween.

In the bleach/softener supplying part 200, the rear wall part 206 of the bleach supplying part 202 and the front wall part 207 of the softener supplying part 204 are spaced apart by a predetermined gap.

In the bleach/softener supplying part 200, the protrusion part 206A of the bleach supplying part 202 is longer provided than the protrusion part 207A of the softener supplying part 204, and the protrusion part 207A of the softener supplying part 204 is positioned at the side of the connection part 206C of the bleach supplying part 202.

The drawer cap 210 is detachable from the drawer 114.

The drawer cap 210 is integrally provided with the bleach siphon cap 218 covering the bleach siphon tube 202 and the softener siphon cap 219 covering the softener siphon tube 205, together.

The drawer cap 210 includes an upper surface part 212 horizontally disposed at upper sides of the wall parts 206 and 207 and having a bottom surface from which the bleach siphon cap 218 and the softener siphon cap 219 are protruded; a front surface part 214 extended downwardly at a front part of the upper surface part 212 and positioned in front of the wall surface 206 of the bleach supplying part 202; and a rear surface part 216 extended downwardly at a rear part of the upper surface part 212 and disposed at the wall surface 207 of the softener supplying part 204.

In the upper surface part 212 that is a member covering the bleach siphon tube 202, the softener siphon tube 205, and the wall parts 206 and 207, the bleach siphon cap 218 is protruded at a position facing the bleach siphon tube 202, and the softener siphon cap 219 is protruded at a position facing the softener siphon cap 205.

The front surface part 214 is downwardly protruded by a maximal height up to which the bleach is stored inside the bleach supplying part 202 at the front part of the upper surface part 212. The front surface part 214 is provided at its rear end with a front horizontal rib 215 horizontally protruded in front, by a predetermined length.

The rear surface part 216 is downwardly protruded by a maximal height up to which the softener is stored inside the softener supplying part 204 at the rear part of the upper surface part 212. The rear surface part 146 is provided at its rear end with a rear horizontal rib 217 horizontally protruded in rear, by a predetermined length.

The drawer cap 210 is provided with a locking protrusion 220 that is inserted into a gap between the spaced wall surfaces 206 and 207 and is locked and fixed by at least one of lower surface parts of the bleach supplying part 202 and the softener supplying part 204.

The locking protrusion 220 includes a bleach supplying part locking protrusion 222 locked and fixed to a lower surface part of the bleach supplying part 202; and a softener supplying part locking protrusion 224 locked and fixed at a lower surface part of the softener supplying part 204.

The bleach supplying part locking protrusion 222 is provided at a side of the softener siphon tube 219 such that it is inserted into the gap between the spaced wall parts 206 and 207 at the time of mounting the drawer cap 210, and is provided at a lower part such that a locking jaw 226 upwardly locked at the lower surface part of the bleach supplying part 202 is protruded in front.

The bleach supplying part locking protrusion 222 is closely attached to the non-protrusion part 206B among the rear wall part 206 of the bleach supplying part 202.

The softener supplying part locking protrusion 224 is provided at a side of the bleach siphon tube 218 such that it is inserted into the gap between the spaced wall parts 206 and 207 at the time of mounting the drawer cap 210, and is provided at a lower part such that a locking jaw 228 upwardly locked at a lower surface part of the softener supplying part 204 is protruded in rear.

The softener supplying part locking protrusion 224 is closely attached to the protrusion part 207A among the front wall part 207 of the softener supplying part 204.

In the detergent supplying apparatus, constituent elements other than the bleach/softener supplying part 200 and the drawer cap 210 are the same as those of the first embodiment and thus, their detailed descriptions will be omitted.

A process of assembling the drawer cap will be described below.

First, the front panel 130 is mounted on the front part 124 of the drawer body 120, and the drawer cap 210 is mounted on the bleach/softener supplying part 200 of the drawer body 120.

The drawer cap 210 is descended and mounted at the bleach supplying part 202 and the softener supplying part 204 of the bleach/softener supplying part 200. The bleach siphon cap 218 covers the bleach siphon cap 203 and also, the softener siphon cap 219 covers the softener siphon cap 205. Besides the bleach supplying part locking protrusion 222, the softener supplying part locking protrusion 224 is inserted between the wall parts 206 and 207 facing the bleach supplying part 202 and the softener supplying part 204.

The bleach supplying part locking protrusion 222 is inserted into the gap between the wall parts 206 and 207, and is closely attached to the rear wall part 206 of the bleach supplying part 202 and is descended. The locking jaw 226 is upwardly locked at the lower surface part of the bleach supplying part 202.

The softener supplying part locking protrusion 224 is inserted into the gap between the wall surfaces 206 and 207, and is closely attached to the front wall part 207 of the softener supplying part 204 and is descended. The locking jaw 228 is upwardly locked at the lower surface part of the softener supplying part 204.

The softener supplying part locking protrusion 224 of the bleach supplying part locking protrusion 222 is disposed in the gap between the spaced wall parts 206 and 207 and thus, has a structure in which it is not exposed to the exterior. An arbitrary disengagement of the drawer cap 210 is limited, and a loss possibility of the drawer cap 210 is minimized.

The drawer cap 210 is assembled such that the locking protrusions 222 and 224 are locked at the lower surface parts of the bleach supplying part 202 and the softener supplying part 204. Thus, the drawer cap 210 can be prevented from being erroneously assembled, depending on whether or not the bleach supplying part locking protrusion 222 and the softener supplying part locking protrusion 224 are locked.

A process of disengaging the drawer cap 210 from the drawer 114 will be described below.

In rear of the bleach/softener supplying part 200, a long tool is inserted between the lower surface part of the softener supplying part 204 and the bottom surface 201 of the bleach/softener supplying part 200 and then, the locking jaw 228 of the softener supplying part locking protrusion 224 is pushed to the front such that the softener supplying part locking protrusion 224 is not locked at the lower surface part of the softener supplying part 204. If the rear horizontal rib 217 provided at the rear surface part 216 of the drawer cap 210 is lifted up, the bleach supplying part locking protrusion 222 is not locked at the lower surface part of the bleach supplying part 202 as the locking jaw 226 is lifted to the rear.

In a state where the bleach supplying locking protrusion 222 and the softener supplying part locking protrusion 224 are not locked, if the rear horizontal rib 217 and the front horizontal rib 215 are caught and lifted, the drawer cap 210 is disengaged from the drawer 114.

In other words, a work of completely disengaging the drawer 114 from the opening 72A of the control panel 72 is preceded, and it is impossible to disengage the drawer cap 210 until a separate tool is used.

Effects of the above constructed detergent supplying apparatus of the washing machine according to the present invention will be described below.

In the detergent supplying apparatus of the washing machine according to the present invention, there is an advantage in that one drawer cap is provided with the bleach siphon cap covering the bleach siphon tube and the softener siphon cap covering the softener siphon tube, together, thereby minimizing the number of parts, and, when the bleach siphon cap and the softener siphon cap are provided separately, it is easy in maintenance and management.

There is an advantage in that, in the partition part that partitions as the bleach supplying part and the softener supplying part, any one of the right and left sides is protruded in front and also, the bleach siphon tube and the softener siphon tube are provided near the rear of the protrusion part and the front of the non-protrusion part of the partition rib, respectively, thereby minimizing a distance of the spaced bleach siphon cap and softener siphon cap as well as a distance of the spaced bleach siphon tube and softener siphon tube, and thus minimizing the front and rear length of the drawer cap. Since the input spaces of the bleach supplying part and the softener supplying part are relatively great, the bleach and the softener can be easily inputted to the input spaces.

There is an advantage in that, if the input spaces of the bleach supplying part and the softener supplying part are increased, the drawer for inputting all of the bleach and the softener to the bleach supplying part and the softener supplying part can be minimized in its drawing width.

There is an advantage in that, since the drawer cap is mounted in a shape of covering the partition part, the input spaces of the bleach supplying part and the softener supplying part are sufficiently spaced apart by the drawer cap and thus, a phenomenon in which the bleach and the softener overflow or are erroneously inputted to a different supplying part can be prevented.

There is an advantage in that the drawer is provided with the bleach supplying part and the softener supplying part such that they are spaced apart and also, the drawer cap is provided with the locking protrusion, which is inserted into the gap of the spaced bleach supplying part and softener supplying part and then is locked and fixed to the lower surface part of the bleach supplying part and the lower surface part of the softener supplying part, and thus the drawer cap can be firmly combined to the drawer, and the locking protrusion is not exposed to the exterior, thereby preventing the arbitrary disengagement of the drawer cap, and preventing the erroneous assembly of the drawer cap by the locking protrusion.

There is an advantage in that, if the arbitrary disengagement of the drawer cap is prevented, the loss danger of the drawer cap is reduced, thereby guaranteeing product stability and reliability and reducing an additional cost taken to purchase the drawer cap.

There is an advantage in that, if the erroneous assembly of the drawer cap is prevented, the siphon tube and the siphon cap are accurately assembled, thereby preventing the discharge performances of the bleach and the softener from being reduced due to an incomplete assembly of the siphon tube and the siphon cap.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

In other words, the partition part employs various structures in which any one of the left and right sides is protruded in front. The partition part can be provided to be bent in a 'S' shape or in a 'W' shape, or to be inclined in a '/' shape.

What is claimed is:

1. A detergent supplying apparatus of a washing machine, the apparatus comprising:

a drawer having a detergent supplying part and a bleach and softener supplying part, the drawer including:

a drawer body comprising a left side wall, a right side wall, a bottom surface, and a plurality of outlets formed at a rear side of the drawer body through which the detergent, the bleach, and the softener are discharged; and a front panel fixed to a front side of the drawer body and provided with a handle portion, wherein a connection wall is formed at the drawer body between the left side wall and the right side wall such that the detergent supplying part and the bleach and softener supplying part are placed side by side in a left and right direction of the drawer body, wherein a partition part is formed at a central portion of a front and rear direction of the bleach and softener supplying part to partition the bleach and softener supplying part as a bleach supplying part having a bleach siphon tube and softener supplying part having a softener siphon tube such that one of the bleach supplying part and the softener supplying part is disposed in a front direction of the other, wherein a single drawer cap is configured to cover the bleach siphon tube and a softener siphon tube, the single drawer cap being provided with a top surface which covers at least the partition part such that the bleach is prevented from flowing into the softener supplying part and the softener is prevented from flowing into the bleach supplying part, wherein the partition part comprises:

a front portion extended from one of the left side wall or the right side wall towards the connection wall in the left and right direction of the drawer box;

a rear portion extended from the connection wall towards the one of the left side wall or the right side wall in the left and right direction of the drawer box, the rear portion being placed in a rear direction of the front portion; and a connection portion formed between the front portion and the rear portion in a front and rear direction of the drawer body for connecting a free end of the front portion and a free end of the rear portion, the connection portion being interposed between the connection wall and one of the left side wall or the right side wall, wherein the bleach siphon tube is positioned at one of a left side or a right side of the connection portion, and the softener siphon tube is positioned at the other side of the connection portion, wherein the drawer cap further comprises:

a front wall bent downwardly from a front portion of the top surface and disposed in a front direction of the front portion of the partition part; and a rear wall bent downwardly from a rear portion of the top surface and disposed in a rear direction of the rear portion of the partition part, and wherein a bleach siphon cap portion for covering the bleach siphon tube and a softener siphon cap portion for covering the softener siphon tube are downwardly protruded for the top surface of the draw cap.

2. The apparatus of claim 1, wherein the partition part is provided at a portion opened at a time of drawing the drawer.

3. The apparatus of claim 1, wherein a horizontal rib is protruded horizontally outside from a lowest portion from at least one of the front surface part and the rear wall.

4. The apparatus of claim 1, further comprising;

a dispenser housing within which the drawer is detachably installed; and a dispenser cover configured to cover and opened top of the dispenser housing, wherein a locking unit is provided on a front portion of at least one of the left side wall and the right side wall of the drawer body to be locked temporarily by a front part of the dispenser cover, a front portion and a rear portion of the locking unit are inclined at a predetermined angle.

5. The apparatus of claim 4, wherein a slit hole is formed at one of a left side and a right side of the locking unit to allow the locking unit to be elastically deformed downwardly.

* * * * *